US010330365B2

(12) United States Patent
Horie et al.

(10) Patent No.: US 10,330,365 B2
(45) Date of Patent: Jun. 25, 2019

(54) AIR-CONDITIONING APPARATUS AND AIR-CONDITIONING SYSTEM THAT SELECTS CONTROL BASED ON SENSIBLE OR LATENT HEAT COOLING CAPABILITY

(71) Applicant: Mitsubishi Electric Corporation, Tokyo (JP)

(72) Inventors: Hayato Horie, Tokyo (JP); Mamoru Hamada, Tokyo (JP); Masaki Toyoshima, Tokyo (JP); Hidemoto Arai, Tokyo (JP); Masami Yasuda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 320 days.

(21) Appl. No.: 15/307,434

(22) PCT Filed: May 13, 2014

(86) PCT No.: PCT/JP2014/062757

§ 371 (c)(1),
(2) Date: Oct. 28, 2016

(87) PCT Pub. No.: WO2015/173897

PCT Pub. Date: Nov. 19, 2015

(65) Prior Publication Data

US 2017/0051959 A1 Feb. 23, 2017

(51) Int. Cl.
*F25B 25/00* (2006.01)
*F25B 49/02* (2006.01)
(Continued)

(52) U.S. Cl.
CPC ..... *F25B 49/02* (2013.01); *F24F 11/89* (2018.01); *F25B 13/00* (2013.01); *F25B 49/022* (2013.01);
(Continued)

(58) Field of Classification Search
CPC ..... F25B 25/00; F25B 2313/0314; F25B 2500/18; F25B 2500/19; F25B 2600/02;
(Continued)

(56) References Cited

FOREIGN PATENT DOCUMENTS

JP H09-014766 A 1/1997
JP 2012-077949 A 4/2012
(Continued)

OTHER PUBLICATIONS

International Search Report of the International Searching Authority dated Aug. 12, 2014 for the corresponding international application No. PCT/JP2014/062757 (and English translation).

*Primary Examiner* — Edward F Landrum
*Assistant Examiner* — Daniel C Comings
(74) *Attorney, Agent, or Firm* — Posz Law Group, PLC

(57) ABSTRACT

A refrigerant circuit forming a refrigeration cycle by connecting together a compressor, an outdoor heat exchanger, an expansion valve, and an indoor heat exchanger via a refrigerant pipe; and a control unit controlling a blown-out air temperature by causing the indoor heat exchanger to exchange heat while controlling the refrigeration cycle based on one of a sensible heat capability and a latent heat capability calculated from a cooling capability of the refrigerant circuit and a cooling load of the refrigerant circuit. The control unit includes: a capability judging unit judging the cooling capability of the refrigerant circuit based on the one of the sensible heat capability and the latent heat capability; and a control selecting unit selecting one from between superheat degree control to control a degree of superheat and evaporating temperature control to control an evaporating temperature, based on a determination result obtained by the capability judging unit.

17 Claims, 14 Drawing Sheets

(51) Int. Cl.

| | |
|---|---|
| ***F25B 13/00*** | (2006.01) |
| ***F24F 11/89*** | (2018.01) |
| *F24F 11/46* | (2018.01) |

(52) U.S. Cl.
CPC ..... *F24F 11/46* (2018.01); *F25B 2313/02741* (2013.01); *F25B 2313/0314* (2013.01); *F25B 2500/18* (2013.01); *F25B 2500/19* (2013.01); *F25B 2600/0253* (2013.01); *F25B 2600/2513* (2013.01); *F25B 2700/02* (2013.01); *F25B 2700/21175* (2013.01)

(58) Field of Classification Search
CPC ..... F25B 2600/025; F25B 2600/0253; F25B 2600/25; F25B 2600/2513
See application file for complete search history.

(56) References Cited

FOREIGN PATENT DOCUMENTS

| | | | |
|---|---|---|---|
| JP | 2012-137210 | A | 7/2012 |
| WO | 2014/061130 | A1 | 4/2014 |

FIG. 5

| | | SENSIBLE HEAT FACTOR OF COOLING CAPABILITY |
|---|---|---|
| RAISE BLOWN-OUT AIR TEMPERATURE | RAISE EVAPORATING TEMPERATURE Te | INCREASES |
| | RAISE DEGREE OF SUPERHEAT SH | CONSTANT |
| LOWER BLOWN-OUT AIR TEMPERATURE | LOWER EVAPORATING TEMPERATURE Te | DECREASES |
| | LOWER DEGREE OF SUPERHEAT SH | CONSTANT |

AIR-CONDITIONING APPARATUS AND AIR-CONDITIONING SYSTEM THAT SELECTS CONTROL BASED ON SENSIBLE OR LATENT HEAT COOLING CAPABILITY

CROSS REFERENCE TO RELATED APPLICATION

This application is a U.S. national stage application of PCT/JP2014/062757 filed on May 13, 2014, the contents of which are incorporated herein by reference.

TECHNICAL FIELD

The present invention relates to an air-conditioning apparatus and an air-conditioning system.

BACKGROUND ART

An air-conditioning apparatus conventionally known is configured to control the supply air temperature, i.e., blown-out air temperature and humidity, by cooling and dehumidifying air and supplying the air to an indoor space (see Patent Literature 1, for example).

The air-conditioning apparatus described in Patent Literature 1 is configured to select one from between superheat degree control and evaporating temperature control in accordance with a cooling capability.

CITATION LIST

Patent Literature

Patent Literature 1: Japanese Unexamined Patent Application Publication No. 9-014766 (paragraph [0029])

SUMMARY OF INVENTION

Technical Problem

When the air-conditioning apparatus described in Patent Literature 1 is used, however, the COP decreases when the air-conditioning apparatus exercises the superheat degree control, and the latent heat capability is insufficient when the air-conditioning apparatus exercises the evaporating temperature control. Accordingly, conventional air-conditioning apparatuses such as that described in Patent Literature 1 have the problem where it is not possible to realize blown-out air temperature control with high energy efficiency, while guaranteeing comfortability.

To solve the problem described above, it is an object of the present invention to provide an air-conditioning apparatus and an air-conditioning system capable of realizing blown-out air temperature control with high energy efficiency, while guaranteeing comfortability.

Solution to Problem

An air-conditioning apparatus according to one embodiment of the present invention includes: a refrigerant circuit forming a refrigeration cycle by connecting together a compressor, an outdoor heat exchanger, an expansion valve, and an indoor heat exchanger via a refrigerant pipe; and a control unit controlling a blown-out air temperature by causing the indoor heat exchanger to exchange heat while controlling the refrigeration cycle based on one of a sensible heat capability and a latent heat capability calculated from a cooling capability of the refrigerant circuit and a cooling load of the refrigerant circuit. The control unit includes: a capability judging unit judging the cooling capability of the refrigerant circuit based on the one of the sensible heat capability and the latent heat capability; and a control selecting unit selecting one from between superheat degree control to control a degree of superheat and evaporating temperature control to control an evaporating temperature, based on a determination result obtained by the capability judging unit.

Advantageous Effects of Invention

The air-conditioning apparatus of one embodiment of the present invention is configured to select one from between the superheat degree control and the evaporating temperature control on the basis of one of the sensible heat capability and the latent heat capability. Accordingly, the air-conditioning apparatus of the one embodiment of the present invention is able to avoid the situation where the latent heat capability is insufficient. Consequently, the air-conditioning apparatus of the one embodiment of the present invention achieves an advantageous effect where it is possible to realize blown-out air temperature control with high energy efficiency.

BRIEF DESCRIPTION OF DRAWINGS

FIG. 5 is a table illustrating examples of fluctuations in a sensible heat factor of a cooling capability exhibited in conjunction with fluctuations in the blown-out air temperature observed when the evaporating temperature control is exercised and when the superheat degree control is exercised according to Embodiment 1 of the present invention.

DESCRIPTION OF EMBODIMENTS

Embodiments of the present invention will be described in details hereinafter with reference to the drawings.

Embodiment 1

A Configuration of Embodiment 1

Figure 1:
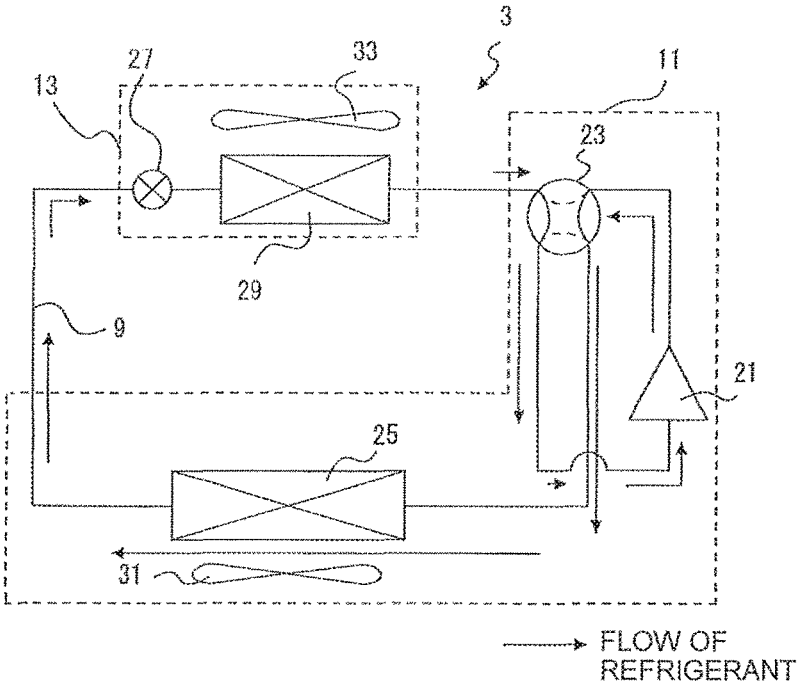
FIG. 1 is a diagram illustrating a schematic configuration of a refrigerant circuit of an air-conditioning apparatus 3 according to Embodiment 1 of the present invention.

FIG. 1 is a diagram illustrating a schematic configuration of a refrigerant circuit of an air-conditioning apparatus 3 according to Embodiment 1 of the present invention. As illustrated in FIG. 1, the air-conditioning apparatus 3 includes an outdoor unit 11 and an indoor unit 13 and is configured to supply blown-out air that air-conditions the temperature and humidity, to an air-conditioned space. The outdoor unit 11 includes a compressor 21, a four-way valve 23, an outdoor heat exchanger 25, and an outdoor fan 31. The indoor unit 13 includes an expansion valve 27, an indoor heat exchanger 29, and an indoor fan 33. The air-conditioning apparatus 3 includes a refrigerant circuit forming a refrigerant cycle by connecting together the compressor 21, the four-way valve 23, the outdoor heat exchanger 25, the expansion valve 27, and the indoor heat exchanger 29, via a refrigerant pipe 9.

The quantity of the indoor unit 13 to be installed may be one or more. The four-way valve 23 may be omitted when the air-conditioning apparatus 3 operates with only one of cooling and heating functions.

Figure 2:
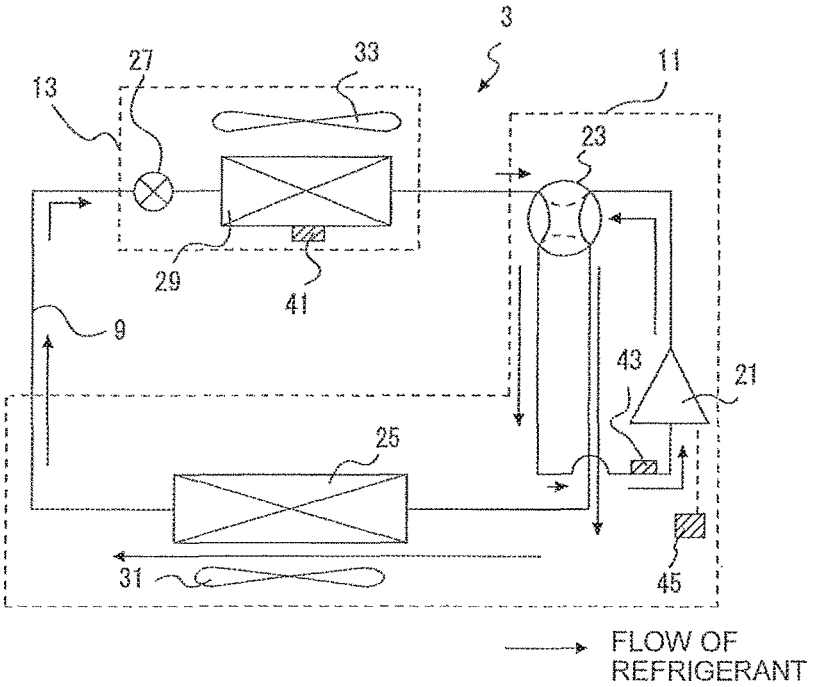
FIG. 2 is a diagram illustrating examples of devices provided for the refrigerant circuit of the air-conditioning apparatus 3 according to Embodiment 1 of the present invention.

FIG. 2 is a diagram illustrating examples of devices provided for the refrigerant circuit of the air-conditioning apparatus 3 according to Embodiment 1 of the present invention. As illustrated in FIG. 2, as the devices provided for the refrigerant circuit, an intake-air temperature/humidity detecting unit 41, an evaporating temperature detecting unit 43, and a compressor frequency adjusting unit 45 are provided, for example. Further, although not illustrated in the drawings, the air-conditioning apparatus 3 also includes a refrigerant superheat degree detecting unit, a blown-out air temperature detecting unit, a blown-out air temperature target value setting unit, and other units.

Figure 3:
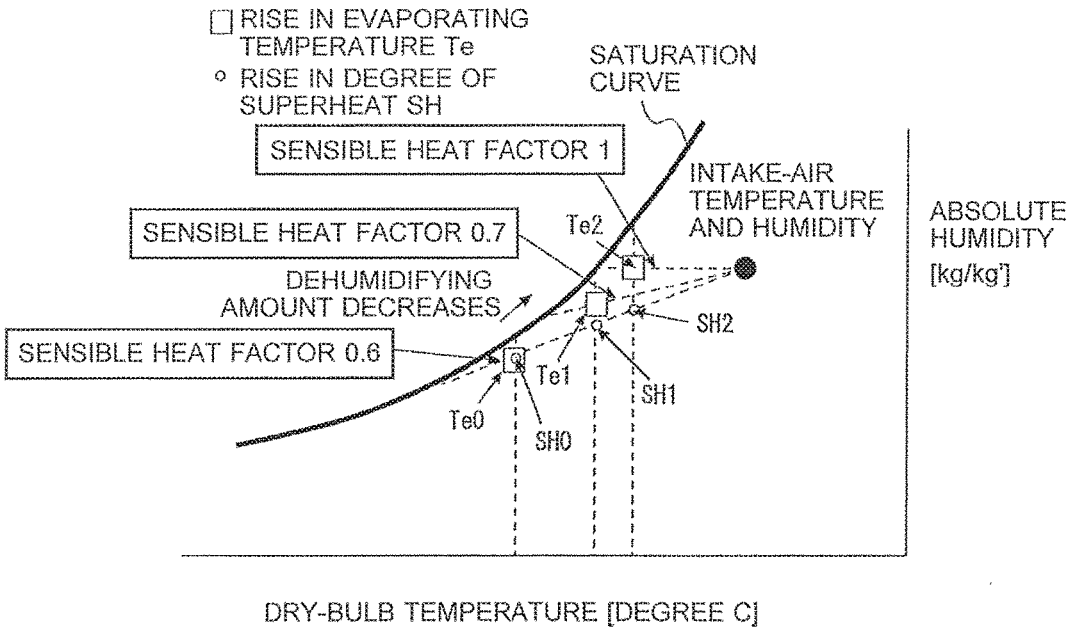
FIG. 3 is a chart illustrating, on a psychrometric chart, examples of fluctuations in a blown-out air temperature observed when evaporating temperature control is exercised and when superheat degree control is exercised according to Embodiment 1 of the present invention.
Figure 4:
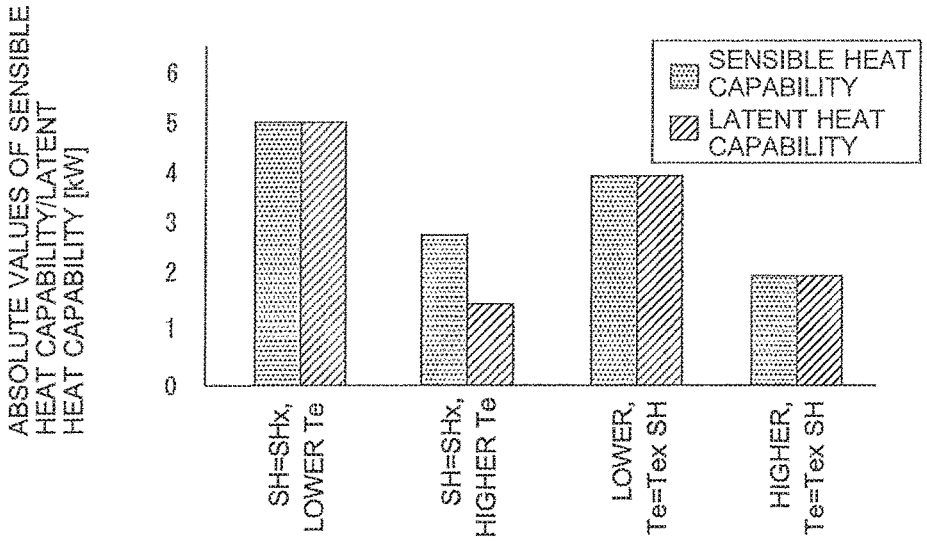
FIG. 4 is a chart illustrating examples of fluctuations in absolute values of sensible heat capability levels and latent heat capability levels corresponding to the evaporating temperature control and the superheat degree control according to Embodiment 1 of the present invention.

Next, fluctuations in a sensible heat capability and a latent heat capability observed in conjunction with fluctuations in an evaporating temperature or a degree of superheat will be explained with reference to FIGS. 3 to 5. FIG. 3 is a chart illustrating, on a psychrometric chart, examples of fluctuations in a blown-out air temperature observed when evaporating temperature control is exercised and when superheat degree control is exercised according to Embodiment 1 of the present invention. FIG. 4 is a chart illustrating examples of fluctuations in absolute values of sensible heat capability levels and latent heat capability levels corresponding to the evaporating temperature control and the superheat degree control according to Embodiment 1 of the present invention. FIG. 5 is a table illustrating examples of fluctuations in a sensible heat factor of a cooling capability exhibited in conjunction with fluctuations in the blown-out air temperature observed when the evaporating temperature control is exercised and when the superheat degree control is exercised according to Embodiment 1 of the present invention.

As illustrated in FIG. 3, when the evaporating temperature rises from Te0 to Te1 while the degree of superheat is the same, the blown-out air temperature rises as indicated with the square symbols. In that situation, as the sensible heat factor of the cooling capability changes and the sensible heat factor gradually increases, the dehumidifying amount decreases. Further, since the evaporating temperature rises, the low-pressure level of the refrigerant circuit rises, and the difference between the low-pressure side and the high-pressure side decreases. Accordingly, the workload of the compressor 21 decreases, and the COP of the refrigeration cycle also increases.

In contrast, when the degree of superheat increases from SH0 to SH1 while the evaporating temperature is the same, the blown-out air temperature rises, as indicated with the circle symbols. In this situation, the sensible heat factor of the cooling capability does not change.

Accordingly, while one of the evaporating temperature control and the superheat degree control is being exercised, even when the blown-out air temperature is the same, the sensible heat factor of the cooling capability and the COP change. For example, as illustrated in FIG. 4, when the evaporating temperature rises while the degree of superheat remains at SHx, the decreasing amount in the absolute value of the latent heat capability is larger than the decreasing amount in the absolute value of the sensible heat capability. Further, as illustrated in FIG. 4, for example, when the degree of superheat increases while the evaporating temperature remains at Tex, the changing amount in the absolute value of the sensible heat capability and the changing amount in the absolute value of the latent heat capability are not different from each other.

In other words, as illustrated in FIG. 5, to raise the blown-out air temperature, there are some situations in which the evaporating temperature is raised and other situations in which the degree of superheat is raised. When the evaporating temperature is raised among those situations, since the sensible heat factor of the cooling capability increases, the ratio of the latent heat capability to the cooling capability decreases. In contrast, when the degree of superheat is raised, the sensible heat factor of the cooling capability is constant.

Further, as illustrated in FIG. 5, for example, to lower the blown-out air temperature, there are some situations in which the evaporating temperature is lowered and other situations in which the degree of superheat is lowered. When the evaporating temperature is lowered among those situations, since the sensible heat factor of the cooling capability decreases, the ratio of the latent heat capability to the cooling capability increases. In contrast, when the degree of superheat is lowered, the sensible heat factor of the cooling capability is constant.

Figure 6:
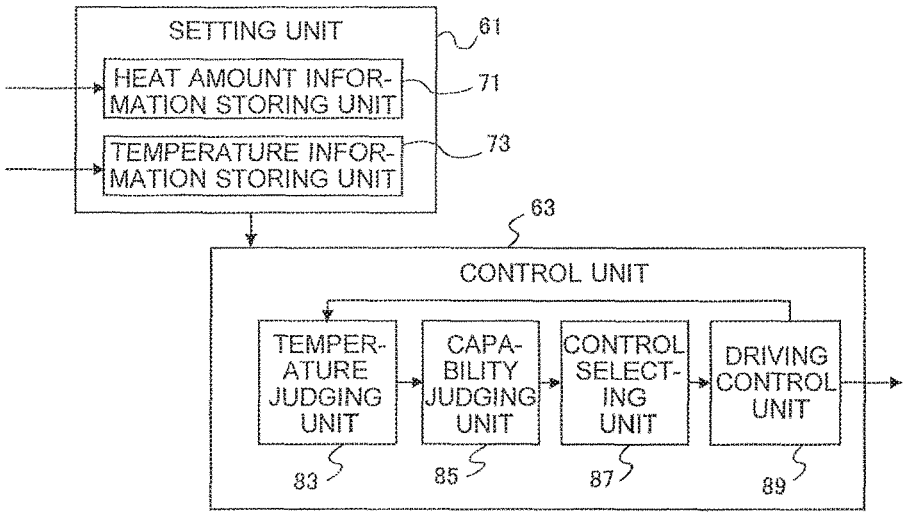
FIG. 6 is a diagram illustrating an example of a functional configuration of a control unit 63 according to Embodiment 1 of the present invention.

Next, an example of blown-out air temperature control utilizing the relationship among the evaporating temperature, the degree of superheat, the sensible heat capability, and the latent heat capability explained with reference to FIG. 5 will be explained with reference to FIG. 6. FIG. 6 is a diagram illustrating an example of a functional configuration of a control unit 63 according to Embodiment 1 of the present invention.

The control unit 63 illustrated in FIG. 6 is configured to control the blown-out air temperature by causing the indoor heat exchanger 29 to exchange heat while controlling the refrigeration cycle on the basis of one of the sensible heat capability and the latent heat capability calculated from the cooling capability of the refrigerant circuit and a cooling load of the refrigerant circuit. As illustrated in FIG. 6, a setting unit 61 is configured to supply information used for controlling the blown-out air temperature to the control unit 63 and includes a heat amount information storing unit 71 and a temperature information storing unit 73. The control unit 63 includes a temperature judging unit 83, a capability judging unit 85, a control selecting unit 87, and a driving control unit 89.

The heat amount information storing unit 71 obtains heat amount information, e.g., processing heat amounts such as a sensible heat capability level and a latent heat processing capability level as well as cooling load information, and supplies the obtained information to the control unit 63. The temperature information storing unit 73 obtains temperature information, e.g., a blown-out air temperature and a blown-out air temperature target value, and supplies the obtained information to the control unit 63.

The temperature judging unit 83 is configured to determine a higher/lower relationship between the blown-out air temperature controlled by the heat exchanging process performed by the indoor heat exchanger 29 and the blown-out air target temperature set value and to further supply the determination result to the capability judging unit 85. The capability judging unit 85 is configured to determine the cooling capability of the refrigerant circuit. More specifically, when the temperature judging unit 83 has determined that the higher/lower relationship is present, the capability judging unit 85 determines the higher/lower relationship on the basis of the latent heat capability and a latent heat load and further supplies the result to the control selecting unit 87.

On the basis of the determination result received from the capability judging unit 85, the control selecting unit 87 is configured to select one from between the superheat degree control to control the degree of superheat and the evaporating temperature control to control the evaporating temperature and to further supply the selection result to the driving control unit 89.

More specifically, the control selecting unit 87 selects the evaporating temperature control, when the temperature judging unit 83 has determined that the blown-out air temperature is lower than the target temperature set value, while the capability judging unit 85 has determined that the latent heat capability is higher than the latent heat load.

In other words, when the blown-out air temperature has not reached the target temperature, while the latent heat capability exceeds the latent heat load, since the latent heat capability is satisfied, there will be no possibility that the latent heat capability becomes excessive when control is exercised to raise the evaporating temperature by which the latent heat capability is decreased. Consequently, an appropriate selection is exercising control to raise the evaporating temperature.

In contrast, the control selecting unit 87 selects the superheat degree control, when the temperature judging unit 83 has determined that the blown-out air temperature is lower than the target temperature set value, while the capability judging unit 85 has determined that the latent heat capability is equal to or lower than the latent heat load.

In other words, when the blown-out air temperature has not reached the target temperature, while the latent heat capability does not exceed the latent heat load, since the latent heat capability is not satisfied, if control were exercised to raise the evaporating temperature by which the latent heat capability would be decreased, the latent heat capability would be insufficient. Consequently, an appropriate selection is exercising control to raise the degree of superheat.

As another example, the control selecting unit 87 selects the superheat degree control, when the temperature judging unit 83 has determined that the blown-out air temperature is equal to or higher than the target temperature set value, while the capability judging unit 85 has determined that the latent heat capability is higher than the latent heat load.

In other words, when the blown-out air temperature exceeds the target temperature, while the latent heat capability exceeds the latent heat load, since the latent heat capability is satisfied, if control were exercised to lower the evaporating temperature by which the latent heat capability would be increased, the latent heat capability would be excessive. Consequently, an appropriate selection is exercising control to lower the degree of superheat.

In contrast, the control selecting unit 87 selects the evaporating temperature control, when the temperature judging unit 83 has determined that the blown-out air temperature is equal to or higher than the target temperature set value, while the capability judging unit 85 has determined that the latent heat capability is equal to or lower than the latent heat load.

In other words, when the blown-out air temperature exceeds the target temperature, while the latent heat of the cooling capability is equal to or lower than the latent heat of the cooling load, since the latent heat capability is not satisfied, the latent heat capability will be increased when control is exercised to lower the evaporating temperature by which the latent heat capability is increased. Consequently, an appropriate selection is exercising control to lower the evaporating temperature.

The driving control unit 89 is configured to control the frequency of the compressor 21 and the opening degree of the expansion valve 27, in accordance with the control selected by the control selecting unit 87.

More specifically, when the temperature judging unit 83 has determined that the blown-out air temperature is lower than the target temperature set value, while the capability judging unit 85 has determined that the latent heat capability is higher than the latent heat load, the driving control unit 89 controls the evaporating temperature by controlling the frequency of the compressor 21.

In contrast, when the temperature judging unit 83 has determined that the blown-out air temperature is lower than the target temperature set value, while the capability judging unit 85 has determined that the latent heat capability is equal to or lower than the latent heat load, the driving control unit 89 controls the degree of superheat by controlling the opening degree of the expansion valve 27.

As another example, when the temperature judging unit 83 has determined that the blown-out air temperature is equal to or higher than the target temperature set value, while the capability judging unit 85 has determined that the latent heat capability is higher than the latent heat load, the driving control unit 89 controls the degree of superheat by controlling the opening degree of the expansion valve 27.

In contrast, when the temperature judging unit 83 has determined that the blown-out air temperature is equal to or higher than the target temperature set value, while the capability judging unit 85 has determined that the latent heat capability is equal to or lower than the latent heat load, the driving control unit 89 controls the evaporating temperature by controlling the frequency of the compressor 21.

As yet another example, when it is determined that there is no difference between the blown-out air temperature and the target temperature set value, the driving control unit 89 ends the control selected by the control selecting unit 87.

An Operation According to Embodiment 1

Figure 7:
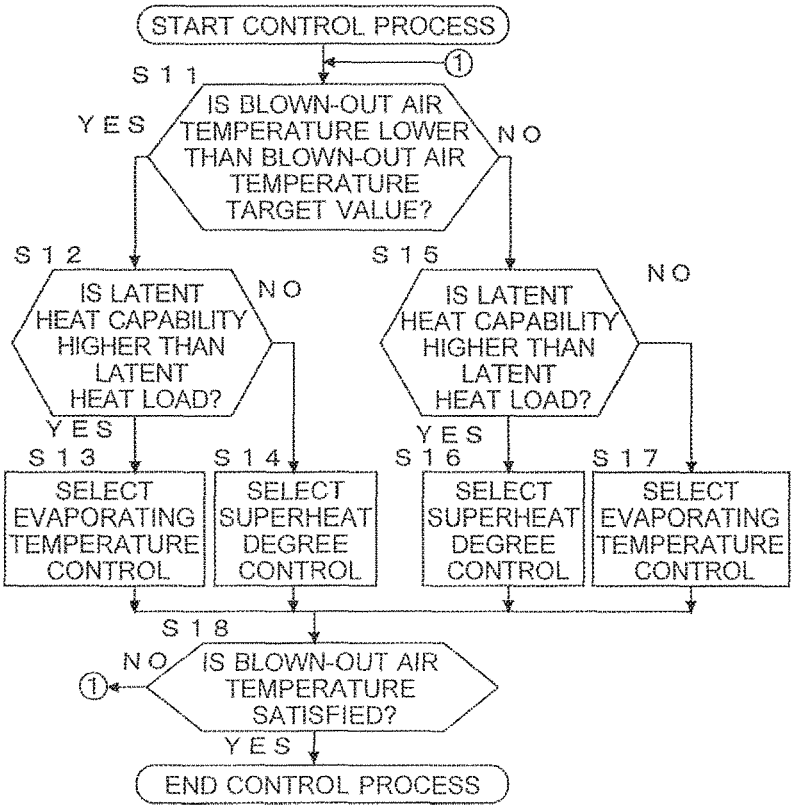
FIG. 7 is a flowchart for explaining an example of control exercised in the air-conditioning apparatus 3 according to Embodiment 1 of the present invention.

Next, an example of the blown-out air temperature control exercised in the air-conditioning apparatus 3 will be explained, with reference to FIG. 7. FIG. 7 is a flowchart for explaining an example of the control exercised in the air-conditioning apparatus 3 according to Embodiment 1 of the present invention.

<Step S11>

The temperature judging unit 83 determines whether or not the difference between the blown-out air temperature and the blown-out air temperature target value is negative. When the difference between the blown-out air temperature and the blown-out air temperature target value is negative, the temperature judging unit 83 proceeds to step S12. On the contrary, when the difference between the blown-out air temperature and the blown-out air temperature target value is not negative, the temperature judging unit 83 proceeds to step S15.

<Step S12>

The capability judging unit 85 determines whether or not the latent heat capability is higher than the latent heat load. When the latent heat capability is higher than the latent heat load, the capability judging unit 85 proceeds to step S13. On the contrary, when the latent heat capability is equal to or lower than the latent heat load, the capability judging unit 85 proceeds to step S14.

<Step S13>

The control selecting unit 87 selects the evaporating temperature control. Further, the control selecting unit 87 supplies a control command related to the selected evaporating temperature control, to the driving control unit 89. On the basis of the control command related to the evaporating temperature control, the driving control unit 89 controls the frequency of the compressor 21. For example, the driving control unit 89 controls the frequency of the compressor 21, by employing the compressor frequency adjusting unit 45.

<Step S14>

The control selecting unit 87 selects the superheat degree control. Accordingly, the control selecting unit 87 supplies a control command related to the selected superheat degree control, to the driving control unit 89. On the basis of the control command related to the superheat degree control, the driving control unit 89 controls the opening degree of the expansion valve 27.

<Step S15>

The capability judging unit 85 determines whether or not the latent heat capability is higher than the latent heat load. When the latent heat capability is higher than the latent heat load, the capability judging unit 85 proceeds to step S16. On the contrary, when the latent heat capability is equal to or lower than the latent heat load, the capability judging unit 85 proceeds to step S17.

<Step S16>

The control selecting unit 87 selects the superheat degree control. Accordingly, the control selecting unit 87 supplies a control command related to the selected superheat degree control to the driving control unit 89. The driving control unit 89 controls the opening degree of the expansion valve 27, on the basis of the control command related to the superheat degree control.

<Step S17>

The control selecting unit 87 selects the evaporating temperature control. Further, the control selecting unit 87 supplies a control command related to the selected evaporating temperature control to the driving control unit 89. The driving control unit 89 controls the frequency of the compressor 21, on the basis of the control command related to the evaporating temperature control. For example, the driving control unit 89 controls the frequency of the compressor 21 by employing the compressor frequency adjusting unit 45.

<Step S18>

The temperature judging unit 83 determines whether or not the blown-out air temperature is satisfied. When the blown-out air temperature is satisfied, the temperature judging unit 83 ends the process. On the contrary, when the blown-out air temperature is not satisfied, the temperature judging unit 83 returns to step S11. Alternatively, in consideration of responsiveness of the refrigerant circuit, the temperature judging unit 83 may determine the temperature when a predetermined time period has elapsed, instead of immediately after the control selected from between the evaporating temperature control and the superheat degree control is exercised.

Advantageous Effects of Embodiment 1

As explained above, according to Embodiment 1, the air-conditioning apparatus 3 is configured to select one from between the superheat degree control and the evaporating temperature control, on the basis of the latent heat capability. More specifically, by exercising the control based on the latent heat capability, when the latent heat capability is insufficient, the air-conditioning apparatus 3 exercises control so that the latent heat will not further be decreased from the current level or so that the latent heat can be increased. Further, by exercising the control based on the latent heat capability, when the latent heat capability is excessive, the air-conditioning apparatus 3 exercises control so that the latent heat will not further be increased from the current level or so that the latent heat can be decreased. Accordingly, the air-conditioning apparatus 3 is able to avoid the situation where the latent heat capability is insufficient. Consequently, the air-conditioning apparatus 3 is able to realize the control over the blown-out air temperature with high energy efficiency.

Further, when exercising the control to raise the evaporating temperature, the air-conditioning apparatus 3 is capable of improving the COP. Consequently, the air-conditioning apparatus 3 is also capable of exercising energy-saving control.

Embodiment 2

A Configuration of Embodiment 2

Figure 8:
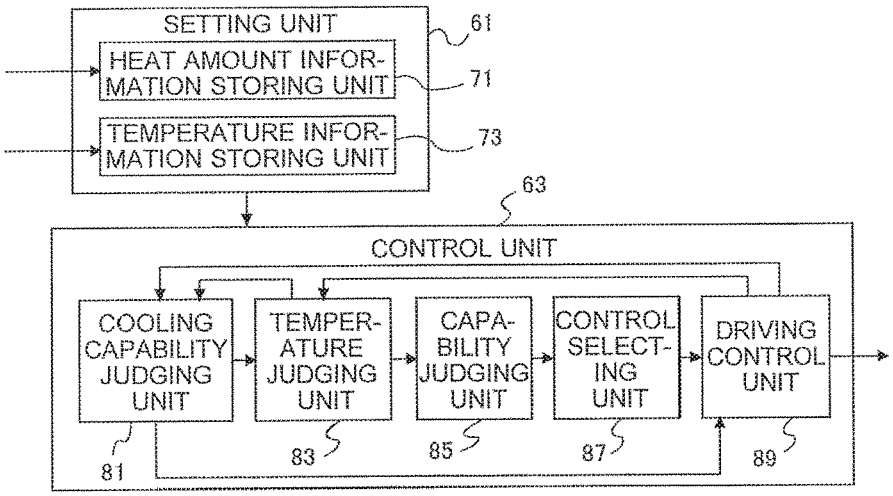
FIG. 8 is a diagram illustrating an example of a functional configuration of the control unit 63 according to Embodiment 2 of the present invention.

FIG. 8 is a diagram illustrating an example of a functional configuration of the control unit 63 according to Embodiment 2 of the present invention. In Embodiment 2, the items that are not particularly noted are the same as those in Embodiment 1. The same functions and configurations will be referred to by using the same reference characters. As illustrated in FIG. 8, the control unit 63 further includes a cooling capability judging unit 81.

The cooling capability judging unit 81 is configured to determine a higher/lower relationship between the cooling capability and the cooling load and to further supply the determination result to one selected from between the temperature judging unit 83 and the driving control unit 89 in accordance with the determination result. More specifically, when the cooling capability is lower than the cooling load, the cooling capability judging unit 81 causes the driving control unit 89 to exercise control so that the cooling capability stops being lower than the cooling load. On the contrary, when the cooling capability is not lower than the cooling load, the cooling capability judging unit 81 causes the temperature judging unit 83 to determine the higher/lower relationship between the blown-out air temperature and the blown-out air temperature target value and further causes the capability judging unit 85 to determine whether or not the latent heat capability has a processing heat amount to process the cooling load. In this situation, the cooling load and the cooling capability each correspond to a processing heat amount of the total heat.

An Operation According to Embodiment 2

Figure 9:
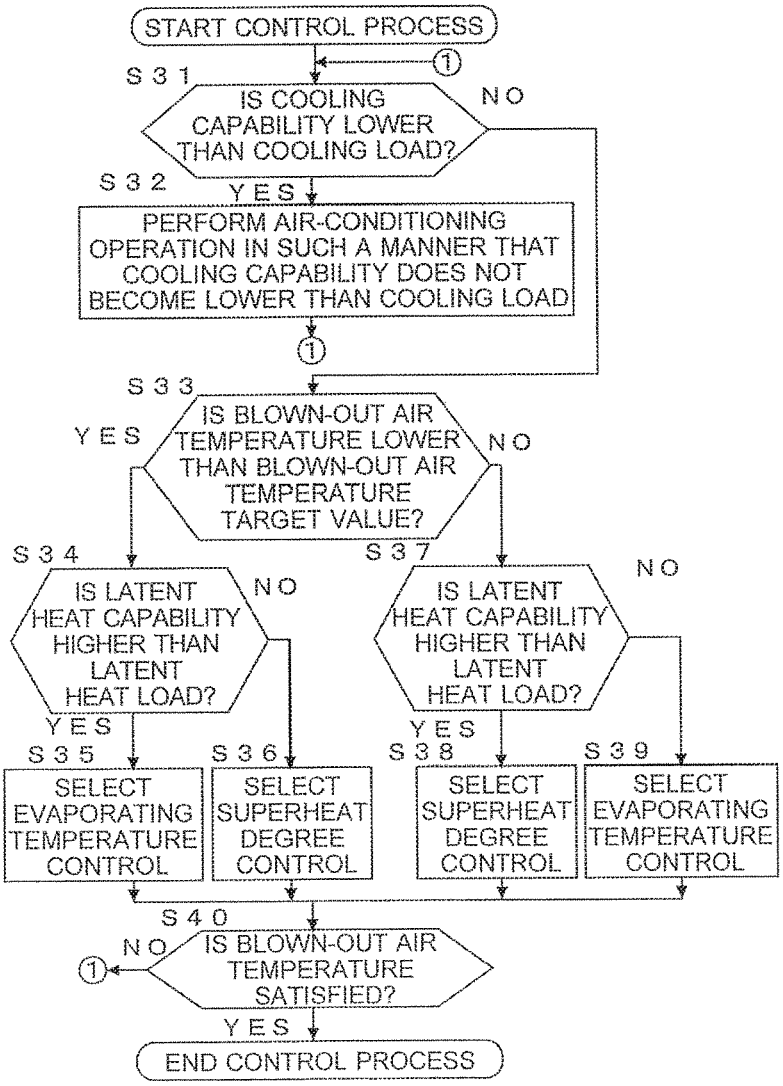
FIG. 9 is a flowchart for explaining an example of control exercised in the air-conditioning apparatus 3 according to Embodiment 2 of the present invention.

FIG. 9 is a flowchart for explaining an example of the control exercised in the air-conditioning apparatus 3 according to Embodiment 2 of the present invention. In the following sections, differences from Embodiment 1 will be explained, and the explanation of the other operations will be omitted. In other words, the processes performed at steps S33 to S40 in FIG. 9 are the same as the processes performed at steps S11 to S18 in FIG. 7.

<Step S31>

The cooling capability judging unit 81 determines whether or not the cooling capability is lower than the cooling load. When the cooling capability is lower than the cooling load, the cooling capability judging unit 81 proceeds to step S32. On the contrary, when the cooling capability is not lower than the cooling load, the cooling capability judging unit 81 performs the operations performed at the temperature judging unit 83 and thereafter.

<Step S32>

The driving control unit 89 performs an air-conditioning operation in such a manner that the cooling capability does not become lower than the cooling load, and the process returns to step S31.

Advantageous Effects of Embodiment 2

As explained above, according to Embodiment 2, the air-conditioning apparatus 3 is configured to compare the higher/lower relationship between the load and the capability with respect to the processing heat amount of the total heat, before proceeding to the latent heat capability determining process and to further perform the operations in accordance with the comparison result. Accordingly, the air-conditioning apparatus 3 is able to perform the process of determining the latent heat capability in the state where the air-conditioned space has been controlled to some extent. Thus, it is possible to enhance the level of precision of the latent heat capability judging process. Further, since the air-conditioning apparatus 3 operates in such a manner that the cooling capability does not become lower than the cooling load, i.e., in such a manner that the cooling capability is kept equal to or higher than the cooling load, the air-conditioning apparatus 3 is able to guarantee comfortability.

Embodiment 3

A Configuration of Embodiment 3

Figure 10:
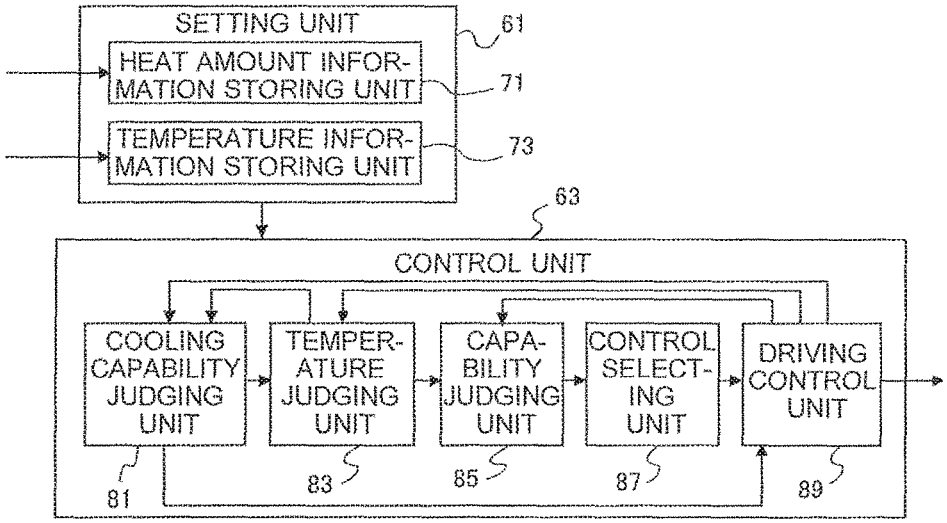
FIG. 10 is a diagram illustrating an example of a functional configuration of the control unit 63 according to Embodiment 3 of the present invention.

FIG. 10 is a diagram illustrating an example of a functional configuration of the control unit 63 according to Embodiment 3 of the present invention. In Embodiment 3, the items that are not particularly noted are the same as those in Embodiments 1 and 2. The same functions and configurations will be referred to by using the same reference characters.

The capability judging unit 85 illustrated in FIG. 10 is configured to determine the processing heat amount by making a comparison of sensible heat factors. More specifically, the capability judging unit 85 determines whether or not the refrigerant circuit has a processing heat amount to process the cooling load, on the basis of a sensible heat factor of the cooling capability and a sensible heat factor of the cooling load. In this situation, the sensible heat factor is a ratio of the sensible heat to the total heat.

Next, a relationship between a comparison using the sensible heat factor and a comparison using the latent heat will be explained. As explained above, as the sensible heat factor of the cooling capability increases, the ratio of the latent heat capability to the cooling capability decreases. On the contrary, as the sensible heat factor of the cooling capability decreases, the ratio of the latent heat capability to the cooling capability increases. Accordingly, by taking the sensible heat factor of the cooling capability into consideration, it is possible to exercise control while taking the ratio of the latent heat capability into consideration. Next, a specific example of the control will be explained.

An example will be explained in which the blown-out air temperature is lower than the blown-out air temperature target value, while the sensible heat factor of the cooling capability is lower than the sensible heat factor of the cooling load. When the sensible heat factor of the cooling capability is lower than the sensible heat factor of the cooling load, it means that the latent heat capability is higher than the latent heat load. Accordingly, in that situation, there will be no possibility that the latent heat capability becomes excessive when control is exercised to raise the evaporating temperature by which the latent heat capability is decreased. Consequently, in that situation, an appropriate selection is exercising control to raise the evaporating temperature, to raise the blown-out air temperature to reach the blown-out air temperature target value.

Next, an example will be explained in which the blown-out air temperature is lower than the blown-out air temperature target value, while the sensible heat factor of the cooling capability is equal to or higher than the sensible heat factor of the cooling load. When the sensible heat factor of the cooling capability is equal to or higher than the sensible heat factor of the cooling load, it means that the latent heat capability is equal to or lower than the latent heat load.

Accordingly, in that situation, if control were exercised to raise the evaporating temperature by which the latent heat capability would be decreased, the latent heat capability would be insufficient. Consequently, in that situation, an appropriate selection is exercising control to raise the degree of superheat, to raise the blown-out air temperature to reach the blown-out air temperature target value.

Next, an example will be explained in which the blown-out air temperature is equal to or higher than the blown-out air temperature target value, while the sensible heat factor of the cooling capability is lower than the sensible heat factor of the cooling load. When the sensible heat factor of the cooling capability is lower than the sensible heat factor of the cooling load, it means that the latent heat capability is higher than the latent heat load. Accordingly, in that situation, if control were exercised to lower the evaporating temperature by which the latent heat processing capability would be increased, the latent heat capability would be excessive. Consequently, in that situation, an appropriate selection is exercising control to lower the degree of superheat, to lower the blown-out air temperature to reach the blown-out air temperature target value.

Next, an example will be explained in which the blown-out air temperature is equal to or higher than the blown-out air temperature target value, while the sensible heat factor of the cooling capability is equal to or higher than the sensible heat factor of the cooling load. When the sensible heat factor of the cooling capability is equal to or higher than the sensible heat factor of the cooling load, it means that the latent heat capability is equal to or lower than the latent heat load. Accordingly, in that situation, the latent heat capability will increase when control is exercised to lower the evaporating temperature by which the latent heat processing capability is increased. Consequently, in that situation, an appropriate selection is exercising control to lower the evaporating temperature, to lower the blown-out air temperature to reach the blown-out air temperature target value.

An Operation According to Embodiment 3

Figure 11:
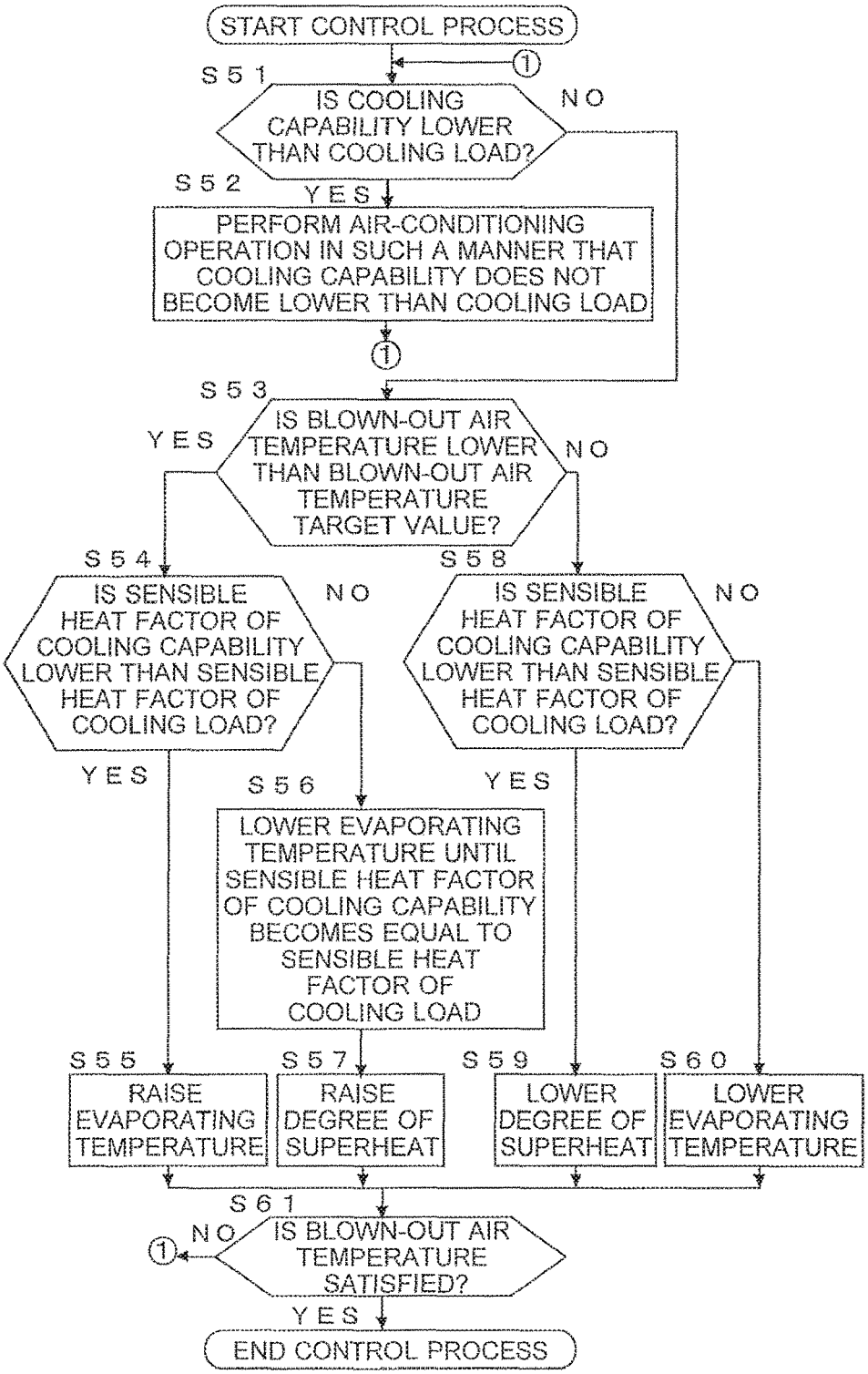
FIG. 11 is a flowchart for explaining an example of control exercised in the air-conditioning apparatus 3 according to Embodiment 3 of the present invention.

FIG. 11 is a flowchart for explaining an example of the control exercised in the air-conditioning apparatus 3 according to Embodiment 3 of the present invention. Operations that are different from those in Embodiments 1 and 2 will be explained, and the explanations of the other operations will be omitted. In other words, the processes performed at steps S51 to S53 and S61 in FIG. 11 are the same as the processes performed at steps S31 to S33 and S40 in FIG. 9.

<Step S54>

The capability judging unit 85 determines whether or not the sensible heat factor of the cooling capability is lower than the sensible heat factor of the cooling load. When the sensible heat factor of the cooling capability is lower than the sensible heat factor of the cooling load, the capability judging unit 85 proceeds to step S55. On the contrary, when the sensible heat factor of the cooling capability is equal to or higher than the sensible heat factor of the cooling load, the capability judging unit 85 proceeds to step S56.

<Step S55>

After the control selecting unit 87 has selected the evaporating temperature control, the driving control unit 89 raises the evaporating temperature.

<Step S56>

After the control selecting unit 87 has selected the evaporating temperature control, the driving control unit 89 lowers the evaporating temperature until the sensible heat factor of the cooling capability becomes equal to the sensible heat factor of the cooling load by cooperating with the capability judging unit 85. As a result, the latent heat of the cooling capability increases, so that the state where the latent heat processing capability satisfies a processing heat amount to process the cooling load is achieved.

<Step S57>

After the control selecting unit 87 has selected the superheat degree control, the driving control unit 89 raises the degree of superheat.

<Step S58>

The capability judging unit 85 determines whether or not the sensible heat factor of the cooling capability is lower than the sensible heat factor of the cooling load. When the sensible heat factor of the cooling capability is lower than the sensible heat factor of the cooling load, the capability judging unit 85 proceeds to step S59. On the contrary, when the sensible heat factor of the cooling capability is equal to or higher than the sensible heat factor of the cooling load, the capability judging unit 85 proceeds to step S60.

<Step S59>

After the control selecting unit 87 has selected the superheat degree control, the driving control unit 89 lowers the degree of superheat.

<Step S60>

After the control selecting unit 87 has selected the evaporating temperature control, the driving control unit 89 lowers the evaporating temperature.

Advantageous Effects of Embodiment 3

As explained above, according to Embodiment 3, the air-conditioning apparatus 3 is configured to select one from between the superheat degree control and the evaporating temperature control on the basis of the sensible heat factors. More specifically, by exercising the control based on the sensible heat factors, when the latent heat capability is insufficient, the air-conditioning apparatus 3 exercises control so that the latent heat will not further be decreased from the current level or so that the latent heat can be increased. Also, by exercising the control based on the sensible heat factors, when the latent heat capability is excessive, the air-conditioning apparatus 3 exercises control so that the latent heat will not further be increased from the current level or so that the latent heat can be decreased. Accordingly, the air-conditioning apparatus 3 is able to avoid the situation where the latent heat capability is insufficient. Consequently, the air-conditioning apparatus 3 is able to realize the control over the blown-out air temperature with high energy efficiency. In addition, since the air-conditioning apparatus 3 operates in such a manner that the cooling capability does not become lower than the cooling load, i.e., in such a manner that the cooling capability is kept equal to or higher than the cooling load, the air-conditioning apparatus 3 is able to guarantee comfortability.

Further, when the blown-out air temperature is lower than the blown-out air temperature target value, while the sensible heat factor of the cooling capability is equal to or higher than the sensible heat factor of the cooling load, the air-conditioning apparatus 3 lowers the evaporating temperature until the sensible heat factor of the cooling capability becomes equal to the sensible heat factor of the cooling load. As a result, the air-conditioning apparatus 3 is able to increase the latent heat capability. Consequently, the air-conditioning apparatus 3 is able to avoid the situation where the latent heat capability is insufficient.

Embodiment 4

A Configuration of Embodiment 4

Figure 12:
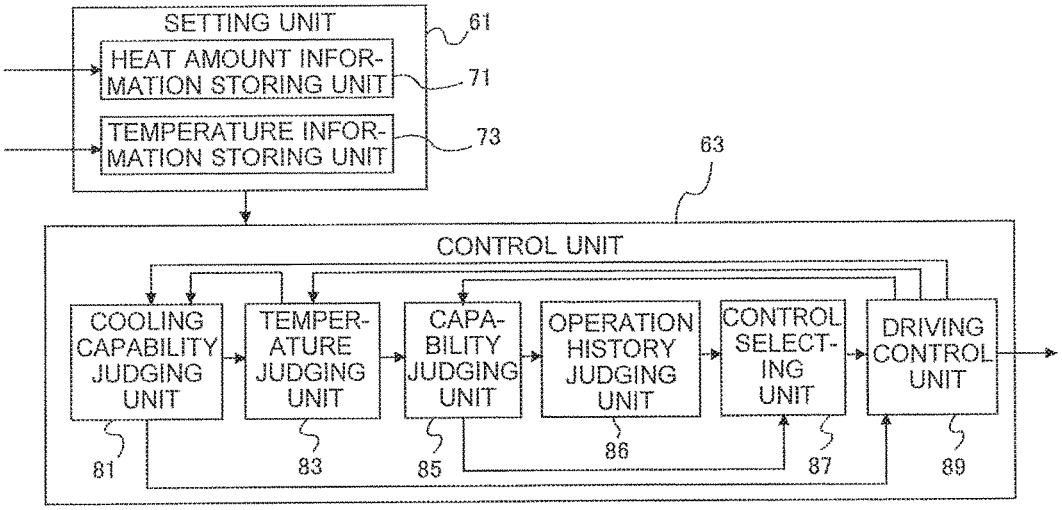
FIG. 12 is a diagram illustrating an example of a functional configuration of the control unit 63 according to Embodiment 4 of the present invention.
Figure 13:
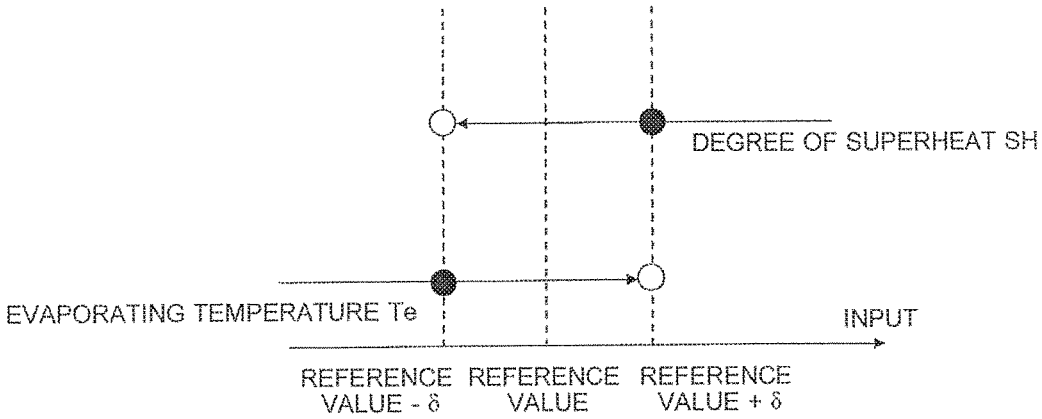
FIG. 13 is a chart illustrating an operation concept of hysteresis control according to Embodiment 4 of the present invention.

FIG. 12 is a diagram illustrating an example of a functional configuration of the control unit 63 according to Embodiment 4 of the present invention. FIG. 13 is a chart illustrating an operation concept of hysteresis control according to Embodiment 4 of the present invention. In Embodiment 4, the items that are not particularly noted are the same as those in Embodiments 1 to 3. The same functions and configurations will be referred to by using the same reference characters.

The control unit 63 further includes an operation history judging unit 86. The operation history judging unit 86 is configured to determine the control selected by the control selecting unit 87 and to prevent the situation where the control is switched frequently between the evaporating temperature control and the superheat degree control.

More specifically, when having determined that an operation to lower the degree of superheat is performed during the superheat degree control selected by the control selecting unit 87, the operation history judging unit 86 causes the control selecting unit 87 to exercise the superheat degree control so as to raise the degree of superheat.

In contrast, when having determined that an operation to raise the evaporating temperature is performed during the evaporating temperature control selected by the control selecting unit 87, the operation history judging unit 86 causes the control selecting unit 87 to exercise the evaporating temperature control so as to lower the evaporating temperature.

As illustrated in FIG. 13, for example, the operation history judging unit 86 has a reference value and a tolerance range ±δ for the reference value. In other words, when the superheat degree control is being exercised, the operation history judging unit 86 keeps the superheat degree control exercised, as long as the value falls in the range "reference value ±δ". Similarly, when the evaporating temperature control is being exercised, the operation history judging unit 86 keeps the evaporating temperature control exercised, as long as the value falls in the range "reference value ±δ".

In other words, when the control selecting unit 87 has selected the superheat degree control, the operation history judging unit 86 keeps the superheat degree control exercised continuously. In contrast, when the control selecting unit 87 has selected the evaporating temperature control, the operation history judging unit 86 keeps the evaporating temperature control exercised continuously.

An Operation According to Embodiment 4

Figure 14:
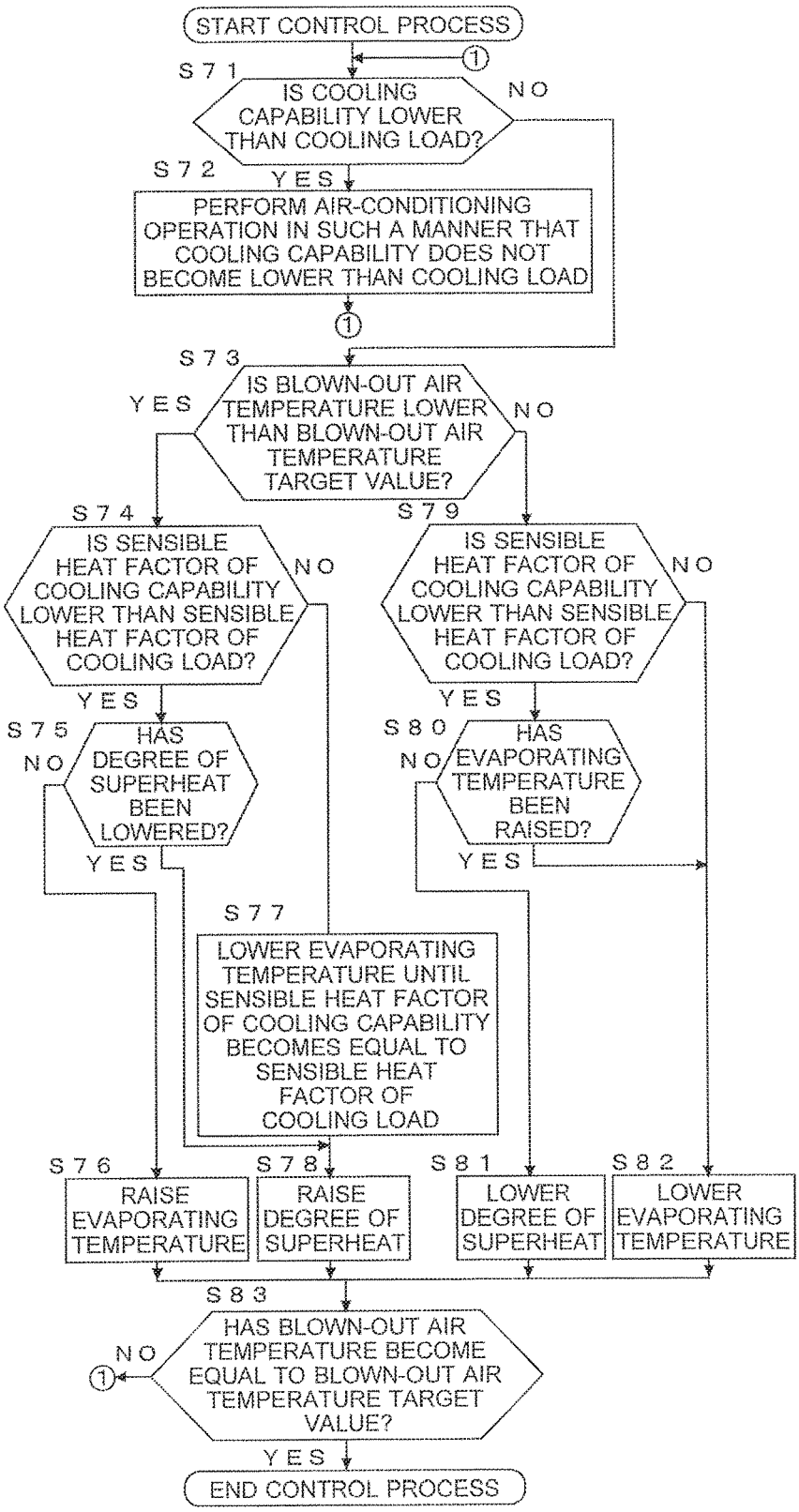
FIG. 14 is a flowchart for explaining an example of control exercised in the air-conditioning apparatus 3 according to Embodiment 4 of the present invention.

FIG. 14 is a flowchart for explaining an example of the control exercised in the air-conditioning apparatus 3 according to Embodiment 4 of the present invention. Explanations of some of the operations that are the same as those in Embodiments 1 to 3 will be omitted. In other words, the processes performed at steps S71 to S74, S76, S77, S79, and S81 in FIG. 14 are the same as the processes performed at steps S51 to S54, S55, S56, S58, and S59 in FIG. 11.

<Step S75>

The operation history judging unit 86 determines whether or not the degree of superheat has been lowered. When the degree of superheat has been lowered, the operation history judging unit 86 proceeds to step S78. On the contrary, when the degree of superheat has not been lowered, the operation history judging unit 86 proceeds to step S76.

<Step S78>

The operation history judging unit 86 raises the degree of superheat.

<Step S80>

The operation history judging unit 86 determines whether or not the evaporating temperature has been raised. When the evaporating temperature has been raised, the operation history judging unit 86 proceeds to step S81. On the contrary, when the evaporating temperature has not been raised, the operation history judging unit 86 proceeds to step S82.

<Step S82>

The operation history judging unit 86 lowers the evaporating temperature.

<Step S83>

The temperature judging unit 83 determines whether or not the blown-out air temperature has become equal to the blown-out air temperature target value. When the blown-out air temperature has become equal to the blown-out air temperature target value, the temperature judging unit 83 ends the process. On the contrary, when the blown-out air temperature has not become equal to the blown-out air temperature target value, the temperature judging unit 83 returns to step S71.

Advantageous Effects of Embodiment 4

As explained above, according to Embodiment 4, the air-conditioning apparatus 3 is configured to keep exercising control by using the same control method as previously used, as long as the value falls in the range "the reference value ±δ". In other words, by incorporating hysteresis into the control methods such as the evaporating temperature control and the superheat degree control, the air-conditioning apparatus 3 is able to avoid the situation where the control method is switched frequently.

Embodiment 5

A Configuration of Embodiment 5

Figure 15:
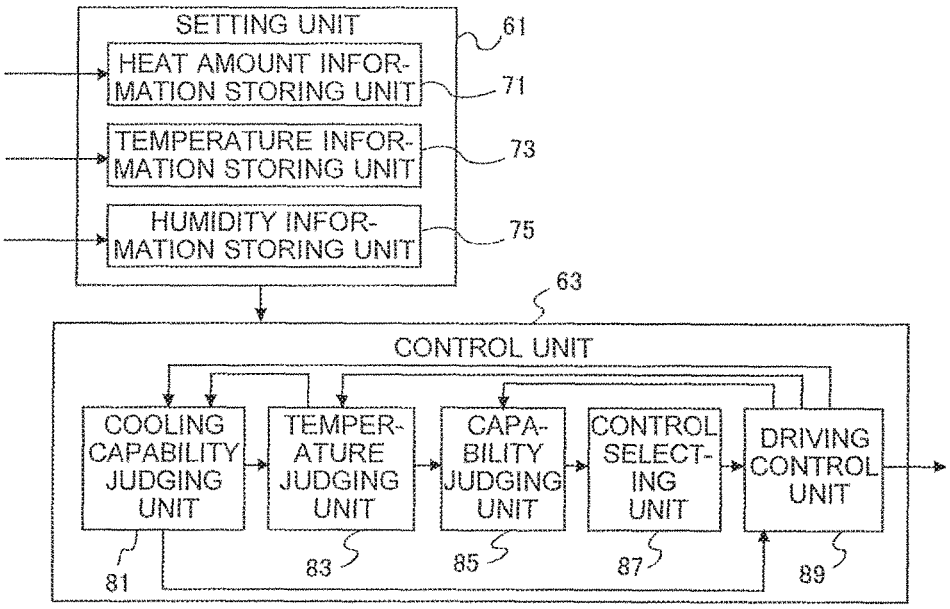
FIG. 15 is a diagram of an example of a functional configuration of the control unit 63 according to Embodiment 5 of the present invention.

FIG. 15 is a diagram of an example of a functional configuration of the control unit 63 according to Embodiment 5 of the present invention. In Embodiment 5, the items that are not particularly noted are the same as those in Embodiments 1 to 4. The same functions and configurations will be referred to by using the same reference characters.

As illustrated in FIG. 15, the setting unit 61 further includes a humidity information storing unit 75. The humidity information storing unit 75 is configured, for example, to obtain an absolute humidity value of the indoor air and a target absolute humidity set value of the indoor air and to further supply the two values to the control unit 63. When the temperature judging unit 83 has determined that the higher/lower relationship is present, the capability judging unit 85 in FIG. 15 judges whether or not the refrigerant circuit has a processing heat amount to process the cooling load required when causing the absolute humidity value of the indoor air to reach the target absolute humidity set value of the indoor air, on the basis of the absolute humidity value of the indoor air and the target absolute humidity set value of the indoor air.

More specifically, when the temperature judging unit 83 has determined that the blown-out air temperature is lower than the target temperature set value, while the capability judging unit 85 has determined that the refrigerant circuit has a processing heat amount to process the cooling load, the control selecting unit 87 selects the evaporating temperature control.

In contrast, when the temperature judging unit 83 has determined that the blown-out air temperature is lower than the target temperature set value, while the capability judging unit 85 has determined that the refrigerant circuit does not have a processing heat amount to process the cooling load, the control selecting unit 87 selects the evaporating temperature control to lower the evaporating temperature until there is no longer a difference between the absolute humidity value of the indoor air and the absolute humidity target value of the indoor air and subsequently selects the superheat degree control. As a result, since the absolute humidity value of the indoor air becomes equal to the absolute humidity target value of the indoor air, the control unit 63 is now in the state where a latent heat processing capability is available.

As another example, when the temperature judging unit 83 has determined that the blown-out air temperature is equal to or higher than the target temperature set value, while the capability judging unit 85 has determined that the refrigerant circuit has a processing heat amount to process the cooling load, the control selecting unit 87 selects the superheat degree control.

In contrast, when the temperature judging unit 83 has determined that the blown-out air temperature is equal to or higher than the target temperature set value, while the capability judging unit 85 has determined that the refrigerant circuit does not have a processing heat amount to process the cooling load, the control selecting unit 87 selects the evaporating temperature control.

An Operation According to Embodiment 5

Figure 16:
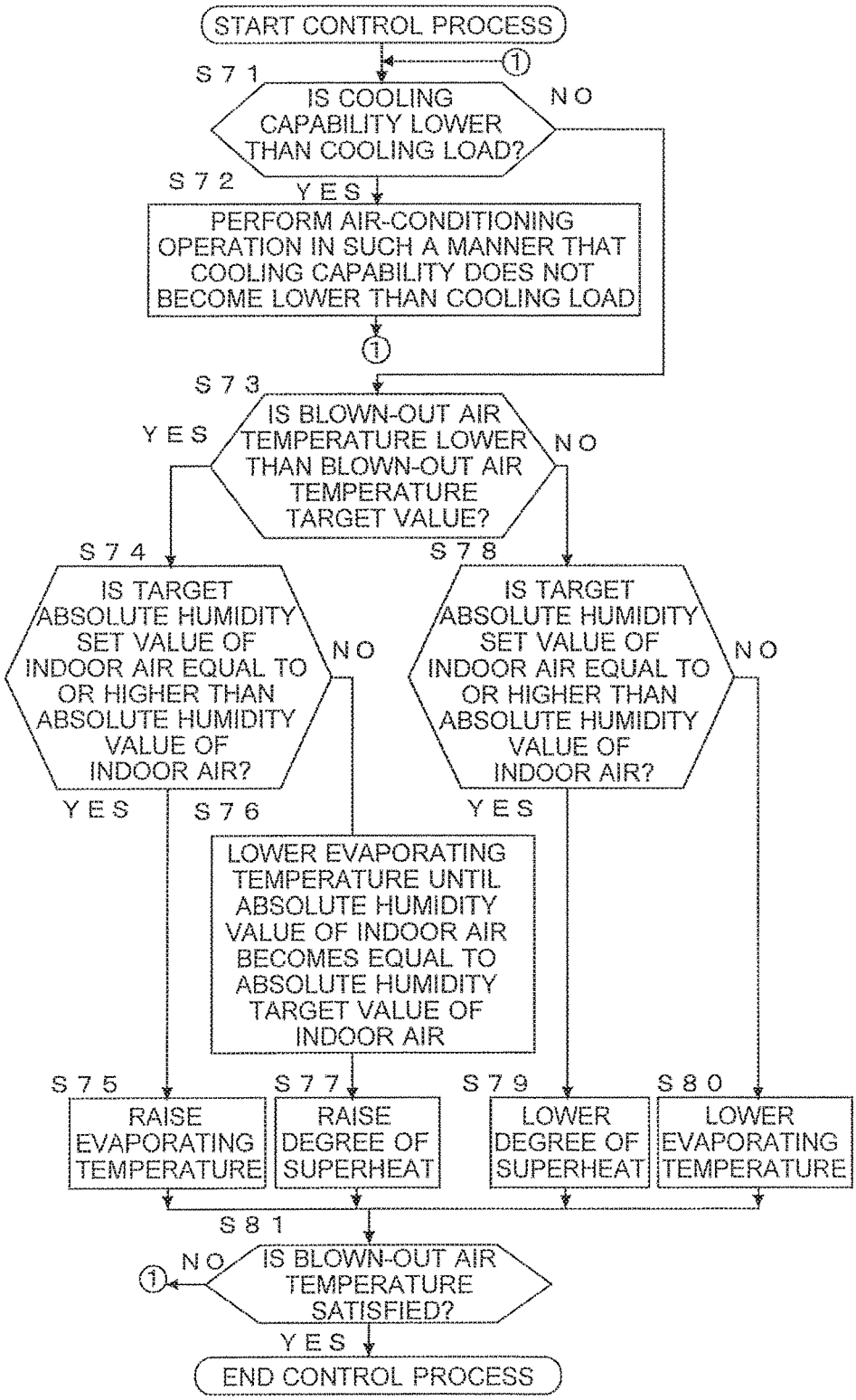
FIG. 16 is a flowchart for explaining an example of control exercised in the air-conditioning apparatus 3 according to Embodiment 5 of the present invention.

FIG. 16 is a flowchart for explaining an example of the control exercised in the air-conditioning apparatus 3 according to Embodiment 5 of the present invention. Explanations of some of the operations that are the same as those in Embodiments 1 to 4 will be omitted. In other words, the processes performed at steps S71 to S73, S75, S77, and S79 to S81 in FIG. 16 are the same as the processes performed at steps S51 to S53, S55, S57, and S59 to S61 in FIG. 11.

<Step S74>

The capability judging unit 85 determines whether or not the target absolute humidity set value of the indoor air is equal to or higher than the absolute humidity value of the indoor air. When the target absolute humidity set value of the indoor air is equal to or higher than the absolute humidity value of the indoor air, the capability judging unit 85 proceeds to step S75. On the contrary, when the target absolute humidity set value of the indoor air is not equal to or higher than the absolute humidity value of the indoor air, the capability judging unit 85 proceeds to step S76.

<Step S76>

In cooperation with the capability judging unit 85, the driving control unit 89 lowers the evaporating temperature until the absolute humidity value of the indoor air becomes equal to the absolute humidity target value of the indoor air.

<Step S78>

The capability judging unit 85 determines whether or not the target absolute humidity set value of the indoor air is equal to or higher than the absolute humidity value of the indoor air. When the target absolute humidity set value of the indoor air is equal to or higher than the absolute humidity value of the indoor air, the capability judging unit 85 proceeds to step S79. On the contrary, when the target absolute humidity set value of the indoor air is not equal to or higher than the absolute humidity value of the indoor air, the capability judging unit 85 proceeds to step S80.

Advantageous Effects of Embodiment 5

As explained above, according Embodiment 5, the air-conditioning apparatus 3 is configured to select one from between the superheat degree control and the evaporating temperature control on the basis of the absolute humidity value. More specifically, by exercising the control based on the absolute humidity value, when the latent heat capability is insufficient, the air-conditioning apparatus 3 exercises control so that the latent heat will not further be decreased from the current level or so that the latent heat can be increased. In contrast, by exercising the control based on the absolute humidity value, when the latent heat capability is excessive, the air-conditioning apparatus 3 exercises control so that the latent heat will not further be increased from the current level or so that the latent heat can be decreased. Accordingly, the air-conditioning apparatus 3 is able to avoid the situation where the latent heat capability is insufficient. Consequently, the air-conditioning apparatus 3 is able to realize the control over the blown-out air temperature with high energy efficiency. In addition, since the air-conditioning apparatus 3 operates in such a manner that the cooling capability does not become lower than the cooling load, i.e., in such a manner that the cooling capability is kept equal to or higher than the cooling load, the air-conditioning apparatus 3 is able to guarantee comfortability.

Furthermore, when the blown-out air temperature is lower than the blown-out air temperature target value, while the target absolute humidity set value of the indoor air is not equal to or higher than the absolute humidity value of the indoor air, the air-conditioning apparatus 3 lowers the evaporating temperature until the absolute humidity value of the indoor air becomes equal to the absolute humidity target value of the indoor air. As a result, the air-conditioning apparatus 3 is able to avoid the situation where the latent heat capability is insufficient.

Embodiment 6

A Configuration of Embodiment 6

Figure 17:
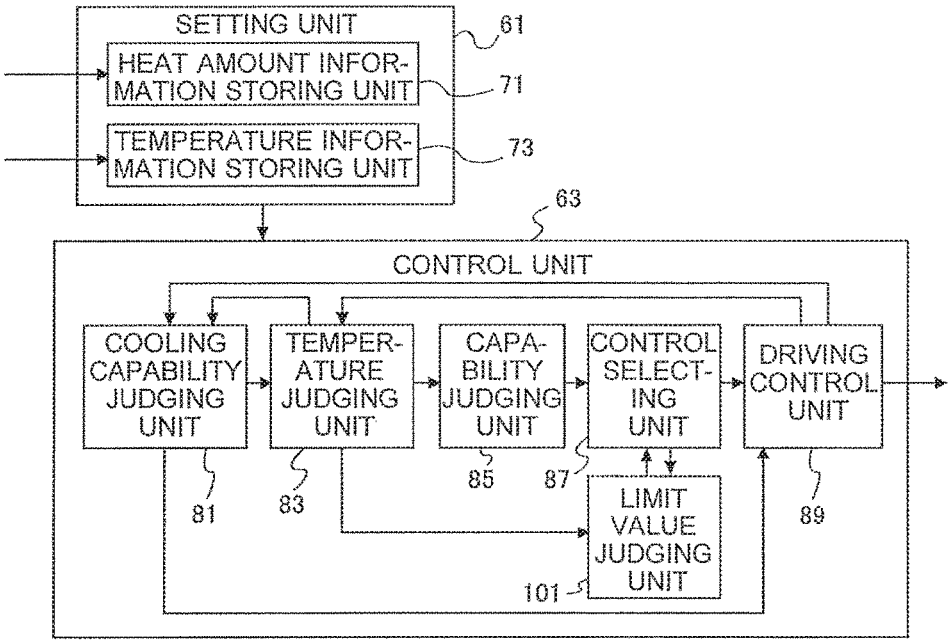
FIG. 17 is a diagram of an example of a functional configuration of the control unit 63 according to Embodiment 6 of the present invention.

FIG. 17 is a diagram of an example of a functional configuration of the control unit 63 according to Embodiment 6 of the present invention. In Embodiment 6, the items that are not particularly noted are the same as those in Embodiments 1 to 5. The same functions and configurations will be referred to by using the same reference characters.

The control unit 63 further includes a limit value judging unit 101. The limit value judging unit 101 is configured to determine a limit value of the evaporating temperature and a limit value of the degree of superheat.

More specifically, when the temperature judging unit 83 has determined that the difference between the blown-out air temperature and the target temperature set value exceeds a predetermined value, while the evaporating temperature observed after an operation under the evaporating temperature control has reached the limit value of the evaporating temperature, the limit value judging unit 101 causes the control selecting unit 87 to select the superheat degree control.

In contrast, when the temperature judging unit 83 has determined that the difference between the blown-out air temperature and the target temperature set value exceeds the predetermined value, while the degree of superheat observed after an operation under the superheat degree control has reached the limit value of the degree of superheat, the limit value judging unit 101 causes the control selecting unit 87 to select the evaporating temperature control.

Figure 18:
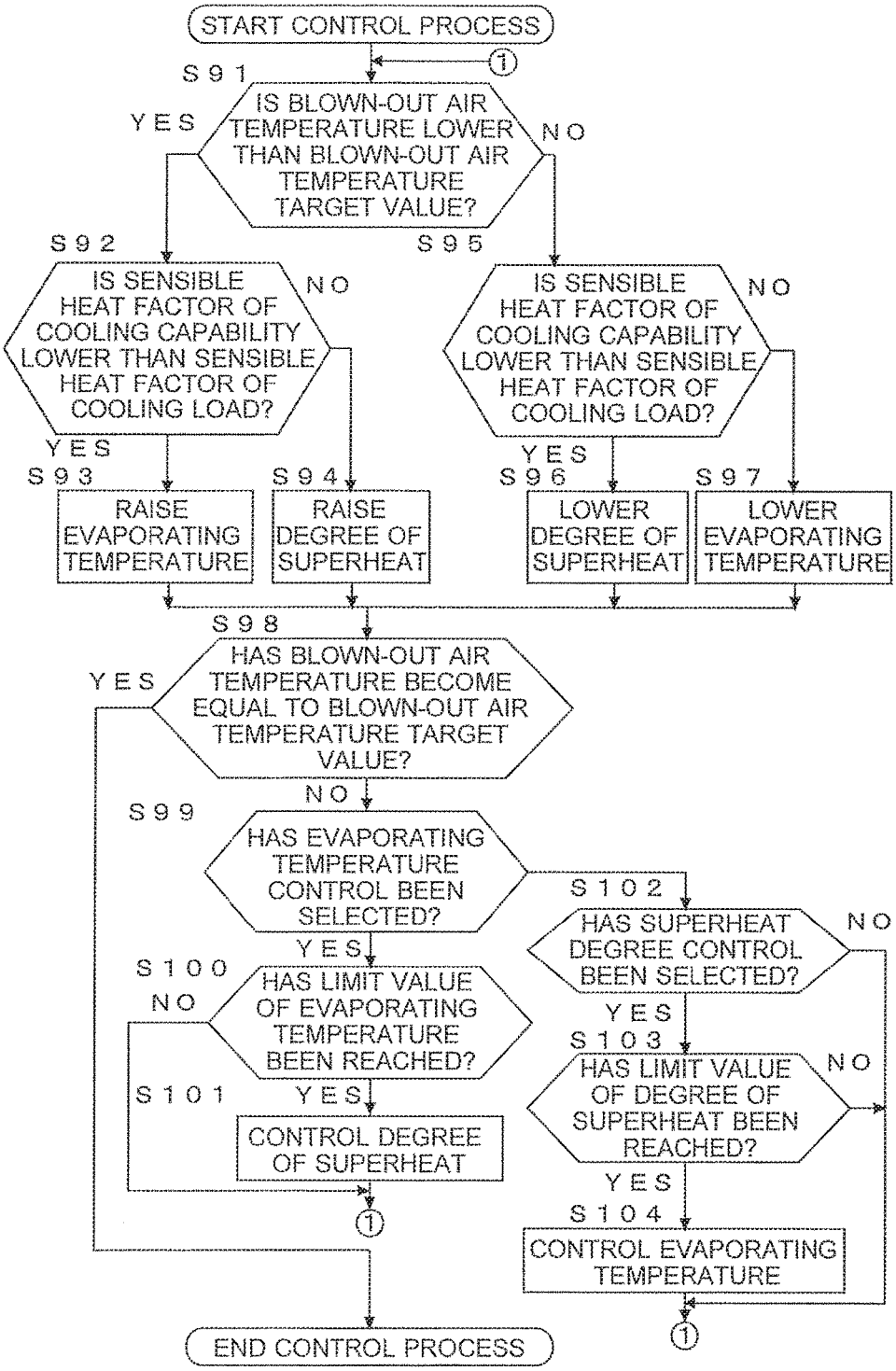
FIG. 18 is a flowchart for explaining an example of control exercised in the air-conditioning apparatus 3 according to Embodiment 6 of the present invention.

FIG. 18 is a flowchart for explaining an example of the control exercised in the air-conditioning apparatus 3 according to Embodiment 6 of the present invention. Explanations of some of the operations that are the same as those in Embodiments 1 to 5 will be omitted. In other words, the processes performed at steps S91 to S97 in FIG. 18 are the same as the processes performed at steps S53 to S55 and S57 to S60 in FIG. 11.

<Step S98>

The temperature judging unit 83 determines whether or not the blown-out air temperature has become equal to the blown-out air temperature target value. When the blown-out air temperature has become equal to the blown-out air temperature target value, the temperature judging unit 83 ends the process. On the contrary, when the blown-out air temperature has not become equal to the blown-out air temperature target value, the temperature judging unit 83 proceeds to step S99.

<Step S99>

The limit value judging unit 101 determines whether or not the evaporating temperature control has been selected. When the evaporating temperature control has been selected, the limit value judging unit 101 proceeds to step S100. On the contrary, when the evaporating temperature control has not been selected, the limit value judging unit 101 proceeds to step S102.

<Step S100>

The limit value judging unit 101 determines whether or not the limit value of the evaporating temperature has been reached. When the limit value of the evaporating temperature has been reached, the limit value judging unit 101 proceeds to step S101. On the contrary, when the limit value of the evaporating temperature has not been reached, the limit value judging unit 101 returns to step S91.

<Step S101>

The limit value judging unit 101 causes the control selecting unit 87 to select the superheat degree control. The driving control unit 89 controls the degree of superheat, and the process returns to step S91.

<Step S102>

The limit value judging unit 101 determines whether or not the superheat degree control has been selected. When the superheat degree control has been selected, the limit value judging unit 101 proceeds to step S103. On the contrary, when the superheat degree control has not been selected, the limit value judging unit 101 returns to step S91.

<Step S103>

The limit value judging unit 101 determines whether or not the limit value of the degree of superheat has been reached. When the limit value of the degree of superheat has been reached, the limit value judging unit 101 proceeds to step S104. On the contrary, when the limit value of the degree of superheat has not been reached, the limit value judging unit 101 returns to step S91.

<Step S104>

The limit value judging unit 101 causes the control selecting unit 87 to select the evaporating temperature control. The driving control unit 89 controls the evaporating temperature, and the process returns to step S91.

Advantageous Effects of Embodiment 6

As explained above, according to Embodiment 6, the air-conditioning apparatus 3 is able to switch the control method into the superheat degree control even when the evaporating temperature has reached the limit value of the control range. Further, the air-conditioning apparatus 3 is able to switch the control method into the evaporating temperature control even when the degree of superheat has reached the limit value of the control range. Accordingly, the air-conditioning apparatus 3 is able to arrange the blown-out air temperature to be close to the blown-out air temperature target value, while taking into consideration the processing heat amount with which the refrigerant circuit processes the cooling load.

Embodiment 7

A Configuration of Embodiment 7

Figure 19:
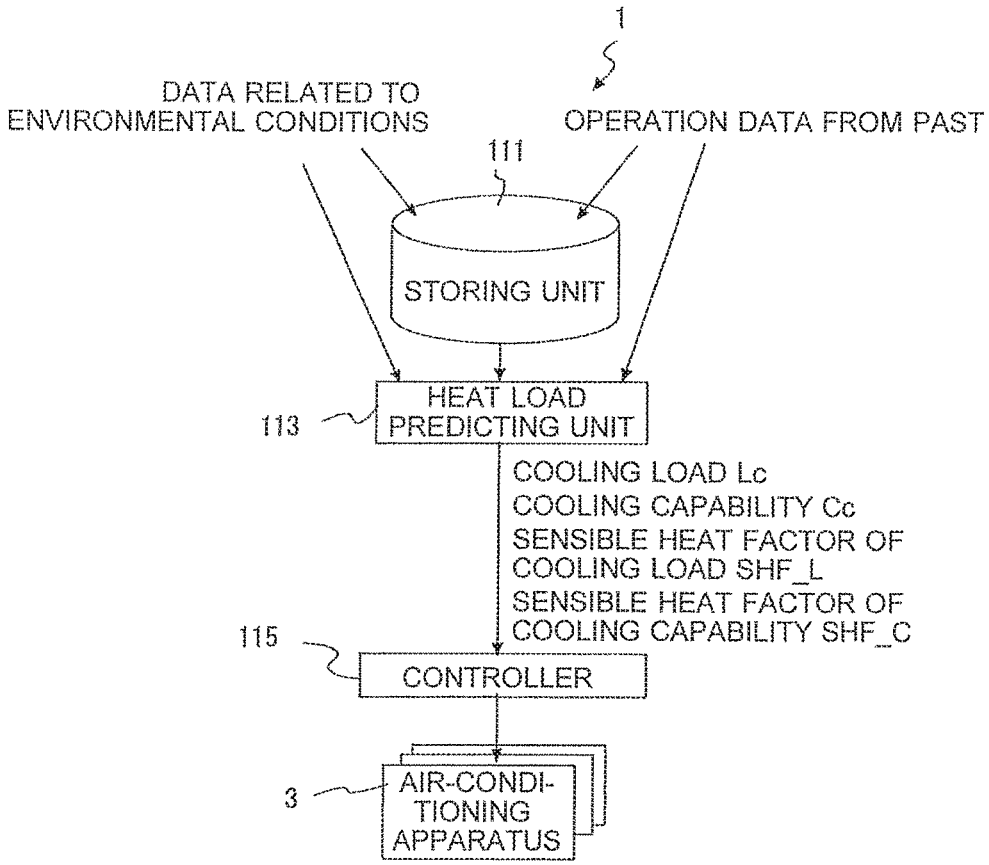
FIG. 19 is a diagram of an example of a schematic configuration of an air-conditioning system 1 according to Embodiment 7 of the present invention.

FIG. 19 is a diagram of an example of a schematic configuration of an air-conditioning system 1 according to Embodiment 7 of the present invention. In Embodiment 7, the items that are not particularly noted are the same as those in Embodiments 1 to 6. The same functions and configurations will be referred to by using the same reference characters.

The air-conditioning system 1 includes a storing unit 111, a heat load predicting unit 113, a controller 115, and a plurality of air-conditioning apparatuses 3 and is configured to select, for the entire system, one from between the superheat degree control and the evaporating temperature control on the basis of the latent heat capability.

The storing unit 111 is configured to store therein, for example, data related to environmental conditions and operation data from a past period (hereinafter, "the past"). The environmental conditions are related to the air-conditioned spaces of the air-conditioning apparatuses 3 and may include, for example, set values and measured values such as an envelope performance of the building, the weather, the number of people who are present in the room, and the temperature and humidity of the indoor air. The operation data from the past denotes operation data from the past of the air-conditioning apparatuses 3 that are put under the control of the controller 115 and operation data from the past of an air-conditioning apparatus that is not put under the control of the controller 115 but is provided in an air-conditioned space similar to that of the air-conditioning apparatuses 3 put under the control of the controller 115. In other words, the operation data from the past includes the operation data from the past of the air-conditioning apparatuses 3 and the operation data from the past of an air-conditioning apparatus 3 that is different from the air-conditioning apparatuses 3.

In other words, the data stored in the storing unit 111 is data to be used for calculating sensible heat factors and other values. For example, an outdoor air total heat load, an outdoor air sensible heat load, an indoor total heat load, an indoor sensible heat load, a heat transmission load, the number of people who are present in the room, and an air volume of ventilation are used for calculating the sensible heat factors and other values.

On the basis of the information stored in the storing unit 111, the heat load predicting unit 113 is configured to calculate, for example, a cooling load, a cooling capability, a sensible heat factor of the cooling load, and a sensible heat factor of the cooling capability and to further supply the calculation results to the controller 115. As explained above, the sensible heat factor is a ratio of the sensible heat to the total heat. For example, "Lc" denotes a cooling load with respect to the total heat and the unit thereof is kW. Further, "Cc" denotes a cooling capability with respect to the total heat, and the unit thereof is kW. Also, "SHF_L" denotes a sensible heat factor of the cooling load and is calculated as "a sensible heat load/a total heat load" and thus requires no unit of measurement. Further, "SHF_C" denotes a sensible heat factor of the cooling capability and is calculated as "a sensible heat capability/a total heat capability" and thus requires no unit of measurement. In the following sections, "Lc" will be referred to as a cooling load, "Cc" will be referred to as a cooling capability, "SHF_L" will be referred to as a sensible heat factor of the cooling load, and "SHF_C" will be referred to as a sensible heat factor of the cooling capability.

On the basis of information that is related to the cooling capability and is supplied from the heat load predicting unit 113, the controller 115 is configured to control the plurality of air-conditioning apparatuses 3 put under the control thereof. More specifically, in accordance with a control command from the controller 115, the air-conditioning apparatuses 3 exercise control based on the latent heat capability to exercise control so that, when the latent heat capability is insufficient, the latent heat will not further be decreased from the current level or the latent heat can be increased. Further, in accordance with a control command from the controller 115, the air-conditioning apparatuses 3 exercise control based on the latent heat capability to exercise control so that, when the latent heat capability is excessive, the latent heat will not further be increased from the current level or the latent heat can be decreased.

Advantageous Effects of Embodiment 7

Accordingly, the air-conditioning apparatuses 3 are able to avoid the situation where the latent heat capability is insufficient, in accordance with the control commands from the controller 115. Consequently, the air-conditioning apparatuses 3 are able to realize the control over the blown-out air temperature with high energy efficiency, in accordance with the control commands from the controller 115.

In this situation, the location where the heat load predicting unit 113 is materialized is not particularly limited. For example, the heat load predicting unit 113 may be provided in a server such as a system management apparatus (not illustrated) or may be provided in the controller 115 disposed on the subordinate side of a server.

A Summary of Embodiments 1 to 7

In the air-conditioning apparatus 3, the control unit 63 is configured to select one from between the superheat degree control and the evaporating temperature control, on the basis of the latent heat capability. Further, the functional configuration of the control unit 63 may be structured by causing a computer program to be executed by hardware such as a microcomputer, a computer, or any other device. Further, the functional configuration of the heat load predicting unit 113 may similarly be structured by causing a computer program to be executed by hardware such as a microcomputer, a computer, or any other device. In other words, the environment in which the operations described above are materialized is not particularly limited.

Further, the flow path of the refrigerant circuit explained above is merely an example and is not particularly limited. For instance, the refrigerant circuit may include a flow path having a reservoir.

REFERENCE SIGNS LIST

1 air-conditioning system 3 air-conditioning apparatus 9 refrigerant pipe 11 outdoor unit 13 indoor unit 21 compressor 23 four-way valve 25 outdoor heat exchanger 27 expansion valve 29 indoor heat exchanger 31 outdoor fan 33 indoor fan 41 intake-air temperature/humidity detecting unit 43 evaporating temperature detecting unit 45 compressor frequency adjusting unit 61 setting unit 63 control unit 71 heat amount information storing unit 73 temperature information storing unit 75 humidity information storing unit 81 cooling capability judging unit 83 temperature judging unit 85 capability judging unit 86 operation history judging unit 87 control selecting unit 89 driving control unit 101 limit value judging unit 111 storing unit 113 heat load predicting unit 115 controller.

The invention claimed is:

1. An air-conditioning apparatus comprising:

a refrigerant circuit forming a refrigeration cycle by connecting together a compressor, an outdoor heat exchanger, an expansion valve, and an indoor heat exchanger via a refrigerant pipe; and a controller configured to control a blown-out air temperature by causing the indoor heat exchanger to perform a heat exchanging process while controlling the refrigeration cycle based on a cooling load, and one of a sensible heat capability and a latent heat capability calculated from a cooling capability of the refrigerant circuit, wherein the controller is further configured to judge the cooling capability of the refrigerant circuit based on the one of the sensible heat capability and the latent heat capability; and select, as a control, between superheat degree control to control a degree of superheat and evaporating temperature control to control an evaporating temperature, based on a determination result of the cooling capability obtained by the controller.

2. The air-conditioning apparatus of claim 1, wherein the controller is further configured to judge a higher-lower relationship between the blown-out air temperature and a blown-out air target temperature set value, and when the controller determines that the higher-lower relationship is present, judge a higher-lower relationship between the latent heat capability and a latent heat load of the refrigerant circuit, as a judgment on the cooling capability of the refrigerant circuit.

3. The air-conditioning apparatus of claim 2, wherein the controller is further configured to select the evaporating temperature control when the controller determines that the blown-out air temperature is lower than the blown-out air target temperature set value while the controller determines that the latent heat capability is higher than the latent heat load, and select the superheat degree control when the controller determines that the blown-out air temperature is lower than the blown-out air target temperature set value while the controller determines that the latent heat capability is equal to or lower than the latent heat load.

4. The air-conditioning apparatus of claim 3, wherein the controller is further configured to control a frequency of the compressor and an opening degree of the expansion valve in accordance with the control selected by the controller, control the evaporating temperature by controlling the frequency of the compressor when the controller determines that the blown-out air temperature is lower than the blown-out air target temperature set value while the controller determines that the latent heat capability is higher than the latent heat load, and control the degree of superheat by controlling the opening degree of the expansion valve when the controller determines that the blown-out air temperature is lower than the blown-out air target temperature set value while the controller determines that the latent heat capability is equal to or lower than the latent heat load.

5. The air-conditioning apparatus of claim 4, wherein the controller is further configured to end the control selected by the controller when the controller determines that there is no difference between the blown-out air temperature and the blown-out air target temperature set value.

6. The air-conditioning apparatus of claim 4, wherein the controller is further configured to judge a higher-lower relationship between the cooling capability and the cooling load, exercise control of the frequency of the compressor and the opening degree of the expansion valve so that, when the cooling capability is lower than the cooling load, the cooling capability stops being lower than the cooling load, and determine the higher-lower relationship between the latent heat capability and the latent heat load when the cooling capability is not lower than the cooling load.

7. The air-conditioning apparatus of claim 2, wherein the controller is further configured to select the superheat degree control when the controller determines that the blown-out air temperature is equal to or higher than the blown-out air target temperature set value while the controller determines that the latent heat capability is higher than the latent heat load, and select the evaporating temperature control when the controller determines that the blown-out air temperature is equal to or higher than the blown-out air target temperature set value while the controller determines that the latent heat capability is equal to or lower than the latent heat load.

8. The air-conditioning apparatus of claim 7, wherein the controller is further configured to control a frequency of the compressor and an opening degree of the expansion valve in accordance with the control selected by the controller, control the degree of superheat by controlling the opening degree of the expansion valve when the controller determines that the blown-out air temperature is equal to or higher than the blown-out air target temperature set value while the controller determines that the latent heat capability is higher than the latent heat load, and control the evaporating temperature by controlling the frequency of the compressor when the controller determines that the blown-out air temperature is equal to or higher than the blown-out air target temperature set value while the controller determines that the latent heat capability is equal to or lower than the latent heat load.

9. The air-conditioning apparatus of claim 2, wherein the controller is further configured to the control unit further includes a limit value judging unit configured to judge a limit value of the evaporating temperature and a limit value of the degree of superheat, select the superheat degree control when the controller determines that a difference between the blown-out air temperature and the blown-out air target temperature set value exceeds a predetermined value while an evaporating temperature resulting from an operation performed under the evaporating temperature control reaches the limit value of the evaporating temperature, and select the evaporating temperature control when the controller determines that the difference between the blown-out air temperature and the blown-out air target temperature set value exceeds the predetermined value while a degree of superheat resulting from an operation performed under the superheat degree control reaches the limit value of the degree of superheat.

10. The air-conditioning apparatus of claim 1, wherein the controller is further configured to judge a higher-lower relationship between a blown-out air temperature resulting from the heat exchanging process performed by the indoor heat exchanger and a blown-out air target temperature set value, and when the controller determines that the higher-lower relationship is present, the controller judges a higher-lower relationship between a sensible heat factor of the cooling capability and a sensible heat factor of the cooling load as a judgment of the cooling capability of the refrigerant circuit.

11. The air-conditioning apparatus of claim 10, wherein the controller is further configured to when the controller determines that the blown-out air temperature is lower than the blown-out air target temperature set value while the capability controller determines that the sensible heat factor of the cooling capability is lower than the sensible heat factor of the cooling load, select the evaporating temperature control, and when the controller determines that the blown-out air temperature is lower than the blown-out air target temperature set value while the controller determines that the sensible heat factor of the cooling capability is equal to or higher than the sensible heat factor of the cooling load, select the evaporating temperature control and lower the evaporating temperature until there is no longer a difference between the sensible heat factor of the cooling capability and the sensible heat factor of the cooling load and subsequently select the superheat degree control.

12. The air-conditioning apparatus of claim 10, wherein the controller is further configured to select the superheat degree control when the controller determines that the blown-out air temperature is equal to or higher than the blown-out air target temperature set value while the controller determines that the sensible heat factor of the cooling capability is lower than the sensible heat factor of the cooling load, and select the evaporating temperature control when the controller determines that the blown-out air temperature is equal to or higher than the blown-out air target temperature set value while the controller determines that the sensible heat factor of the cooling capability is equal to or higher than the sensible heat factor of the cooling load.

13. The air-conditioning apparatus of claim 10, wherein the controller is further configured to judge the control selected by the controller, when determining that an operation to control the degree of superheat is performed during the superheat degree control selected by the controller, exercise the superheat degree control to control the degree of superheat, and when determining that an operation to control the evaporating temperature is performed during the evaporating temperature control selected by the controller, exercise the evaporating temperature control to control the evaporating temperature.

14. The air-conditioning apparatus of claim 1, wherein the controller is further configured to judge a higher-lower relationship between a blown-out air temperature resulting from the heat exchanging process performed by the indoor heat exchanger and a blown-out air target temperature set value, and when the controller determines that the higher-lower relationship is present, judge a higher-lower relationship between an indoor air absolute humidity value and an indoor air target absolute humidity set value as a judgment of the cooling capability of the refrigerant circuit.

15. The air-conditioning apparatus of claim 14, wherein the controller is further configured to when the controller determines that the blown-out air temperature is lower than the blown-out air target temperature set value while the controller determines that the indoor air target absolute humidity set value is equal to or higher than the indoor air absolute humidity value, select the evaporating temperature control, and when the controller determines that the blown-out air temperature is lower than the blown-out air target temperature set value while the controller determines that the indoor air target absolute humidity set value is lower than the indoor air absolute humidity value, select the evaporating temperature control and lower the evaporating temperature until there is no longer a difference between the indoor air absolute humidity value and the indoor air absolute humidity target value and subsequently select the superheat degree control.

16. The air-conditioning apparatus of claim 14, wherein the controller is further configured to select the superheat degree control when the controller determines that the blown-out air temperature is equal to or higher than the blown-out air target temperature set value while the controller determines that the indoor air target absolute humidity set value is equal to or higher than the indoor air absolute humidity value, and select the evaporating temperature control when the controller determines that the blown-out air temperature is equal to or higher than the blown-out air target temperature set value while the controller determines that the indoor air target absolute humidity set value is lower than the indoor air absolute humidity value.

17. An air-conditioning system comprising:

the air-conditioning apparatus of claim 1;

a computer configured to predict information related to the cooling capability of the refrigerant circuit;

a storage configured to store therein, as information serving as a base for information predicted by the computer, data related to an environmental condition in a space air-conditioned by the air-conditioning apparatus, operation data from a past period of the air-conditioning apparatus, and operation data from a past period of another air-conditioning apparatus different from the air-conditioning apparatus; and an air-conditioning apparatus controller configured to control a plurality of air-conditioning apparatuses including the air-conditioning apparatus.

* * * * *